United States Patent [19]

Toda et al.

[11] Patent Number: 4,989,513

[45] Date of Patent: Feb. 5, 1991

[54] METHOD FOR PRINTING TEST AND APPARATUS FOR DOING THE SAME

[75] Inventors: Yukio Toda, Omiya; Takeshi Nakatsuka, Hiki; Toru Takahashi, Warabi; Haruhito Arakawa, Urawa, all of Japan

[73] Assignee: Dainippon Ink and Chemicals Inc., Tokyo, Japan

[21] Appl. No.: 221,907

[22] PCT Filed: Oct. 7, 1987

[86] PCT No.: PCT/JP87/00756

§ 371 Date: Jun. 6, 1988

§ 102(e) Date: Jun. 6, 1988

[87] PCT Pub. No.: WO88/02696

PCT Pub. Date: Apr. 21, 1988

[30] Foreign Application Priority Data

Oct. 7, 1986 [JP] Japan ..... 61-237115

[51] Int. Cl.[5] ..... B41F 3/20; B41F 3/36; B41F 3/51

[52] U.S. Cl. ..... 101/158; 101/269; 101/170

[58] Field of Search ..... 101/150, 158, 159, 160, 101/161, 162, 133, 146, 186, 170, 187, 188, 250, 251, 169, 252, 256, 282, 269, 484

[56] References Cited

U.S. PATENT DOCUMENTS 4,558,643 12/1985 Arima et al. ..... 101/158
4,706,565 11/1987 Martin ..... 101/151

FOREIGN PATENT DOCUMENTS 50-13113 2/1975 Japan .

*Primary Examiner*—J. Reed Fisher
*Attorney, Agent, or Firm*—Burns, Doane, Swecker & Mathis

[57] ABSTRACT

The ink is dropped onto a flat plate, and then supplied to a printing area by a doctor blade. An impression pressure cylinder around which a material to be printed is wound is then rolled against the plate under a predetermined printing pressure, or the plate is moved to the impression cylinder and rotated freely in a predetermined position by the frictional resistance thereof with respect to the plate. Thus, the ink on the printing area is transferred to the material to be printed to carry out printing. The rolling of impression cylinder or moving of the plate is performed by a pneumatic cylinder. The printing speed, the interruption of the movements of the impression cylinder or plate, and the returning of the impression cylinder or plate to its original position after the completion of the printing operation are controlled by regulating the pressure supplied to the air cylinder.

16 Claims, 5 Drawing Sheets

METHOD FOR PRINTING TEST AND APPARATUS FOR DOING THE SAME

DESCRIPTION

1. Technical Field

The present invention relates to a method for high accuracy printing test for gravure printing and an apparatus for doing the same.

2. Background Art

In the field of printing, the impression quality of printed matters depends upon various factors, but among others, the tint or nuance of inks used in the printing is an extremely important factor. Normally, to obtain a color matching of a color sample, a desired ink is prepared by mixing several kinds of standard-color ink. Namely, it is necessary to attain a color matching.

Heretofore, this color matching has been done by repeating the preparation of comparison ink samples by knifing using ink mixtures and visually comparing the knifed ink samples with the color samples.

Recently, however, a method of color matching has been more and more adopted in which a small motor-driven printing testing apparatus is used to do a trial printing at a predetermined speed to prepare a comparison sample, and the sample thus made is measured by optically and electrically measuring means and the measured values thus obtained are processed by a computer to judge whether or not the color of the prepared ink matches the color sample.

Heretofore, some printing testing apparatuses have been proposed for the above-mentioned purpose, and one of them is disclosed in the Unexamined Japanese Patent Publication (Kokai) No. 60-189446. This proposed small printing testing apparatus uses a pulse or stepping motor to roll the impression cylinder on the flat intaglio while controlling the speed of the impression cylinder. A printing testing apparatus using a reversible motor is also known.

However, such a small printing testing apparatus is required to have a function to attain a considerably high speed of a movement over a short distance in a short time, for example, a speed of 100 m/min and then stop the movement. In case a flat intaglio is used in the apparatus, the impression cylinder or intaglio has to be moved horizontally. Therefore, means for driving the impression cylinder or intaglio and its associated elements must be sufficiently strong and durable. With the conventional printing testing apparatus using a motor, however, it is difficult to maintain the durability, and so it is hard to reproduce a good print quality for a long time.

Also in the conventional printing testing apparatus, the printing pressure of the impression cylinder and the pressure of the doctor blade are adjusted by means of adjusting screws, respectively. So after replacement of the intaglio, impression cylinder and the doctor blade, it is difficult to meet the same requirements which have been met before that replacement, and it is not possible to provide a test printing or proofing of a high reproducibility and precision.

DISCLOSURE OF INVENTION

The present invention has an object to overcome the above-mentioned drawbacks of the conventional techniques by providing a printing testing apparatus capable of moving the intaglio mount and head (impression cylinder) at a desired speed at any time, that is, capable of always providing for a desired printing speed; incurring neither failure of the drive nor deterioration of accuracy even if used repeatedly for a long period; usable by a method for printing test which ensures always an appropriate printing pressure and contact pressure of doctor blade and in a stable state for a long period; having an excellent reproducibility; easy to maintain and care; and not expensive.

The aforementioned problems are solved by adjusting the movement and moving speed of the intaglio mount or head (impression cylinder) by a pneumatic cylinder connected to a compressor and a pressure adjusting means, and applying and adjusting the printing pressure of the impression cylinder and the contact pressure of the doctor blade by a pressure cylinder, such as a pneumatic or hydraulic cylinder, and a pressure adjusting means.

The moving speed of the piston within the pneumatic cylinder for moving the intaglio mount or head is in proportion to a magnitude per a unit area of the air pressure acting upon the piston, if the friction resistance and inertia of each part are ignored. Therefore, by adjusting, by the throttle valve, etc., the air pressure supplied to the pneumatic cylinder, it is possible to freely adjust the moving speed, namely, the printing speed, of the intaglio mount or head (impression cylinder) connected to the piston rod. The moving stroke (travel) of 20 to 40 cm is sufficient.

The aforementioned pneumatic cylinder should desirably be of a following type. Namely, when moving the intaglio mount or head for a printing process, a compressed air sufficient enough to provide any desired printing speed is supplied to the aforementioned intaglio cylinder through a main pipe. To reduce the speed of the intaglio mount or head and finally stop it after a printing is completed, the supply of the compressed air through the main pipe is stopped and a compressed air nearly equal in pressure to the compressed air from the main pipe is immediately supplied from a sub pipe connected to an opposite side of the main pipe with respect to the piston of the aforementioned pneumatic cylinder located between the main and sub pipes, thereby slowing down the motion of the piston. Further, the pneumatic cylinder should preferably be a double-acting cylinder permitting, after one printing process is over, to return, for a next printing, the intaglio mount or head to their initial positions at a speed slower than the speed in the printing process.

For the above-mentioned movement of the pneumatic cylinder, it is necessary to provide a quick changeover between the supply of compressed air to the pneumatic cylinder and stop of the supply. For this purpose, a solenoid valve is used in the fluid passage along the pipe and it is automatically controlled by electric signals.

The pressure cylinder for imparting a printing pressure and the pressure cylinder for imparting a contact pressure of the doctor blade are not limited to any special types but any pressure cylinders may be used. For imparting a printing pressure, a double-acting cylinder is employed which uses a compressed air or hydraulic pressure for both the forward and reverse movements. For imparting a doctor blade contact pressure, a single-acting cylinder can be employed which uses a spring for a return movement, since the doctor blade is lightweight.

BEST MODE FOR CARRYING OUT THE INVENTION

Preferred embodiments of this invention will now be described in detail with reference to the attached drawings.

Figure 1:
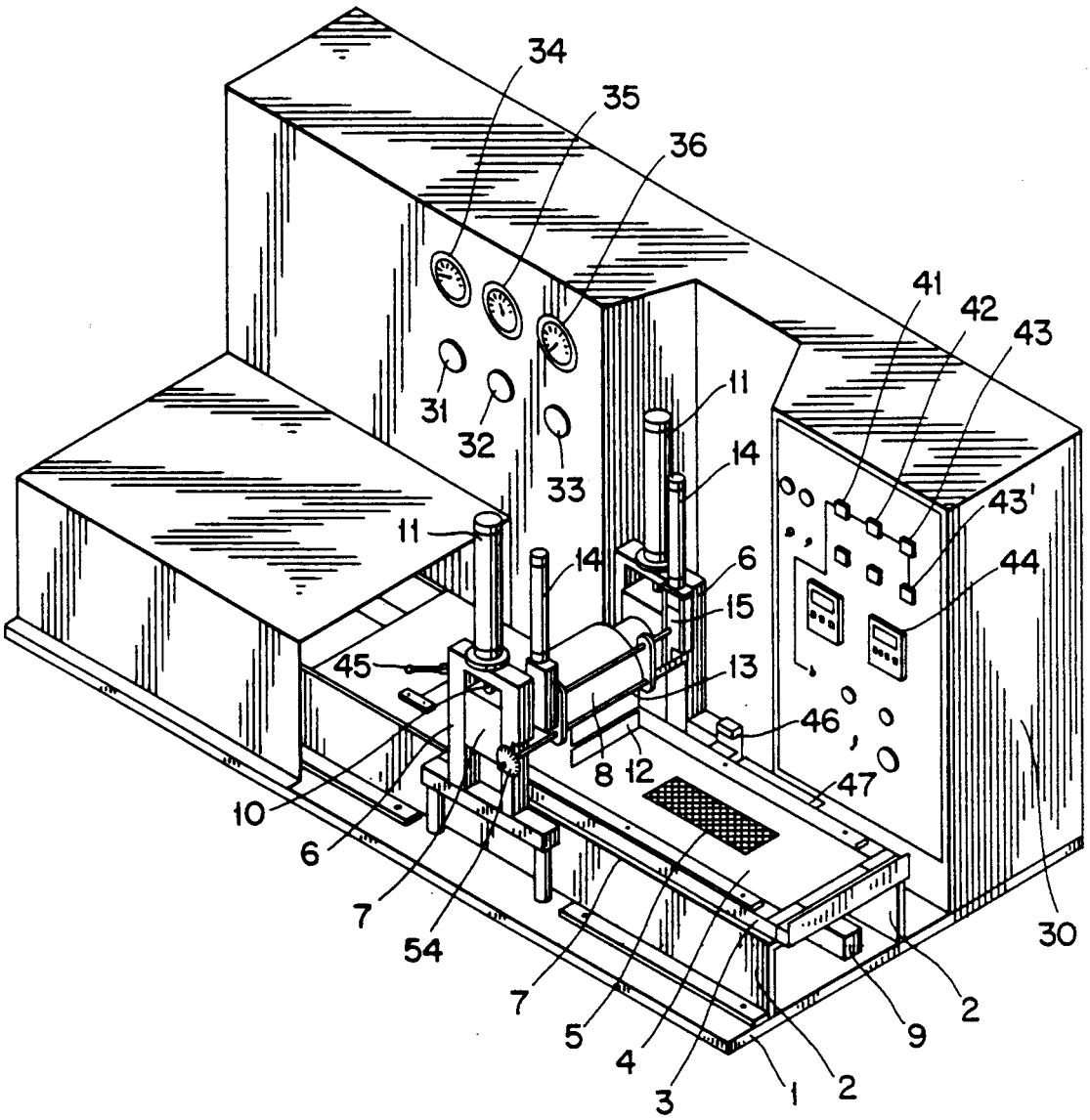
FIG. 1 is a perspective view of one embodiment of the printing testing apparatus according to the present invention.
Figure 2:
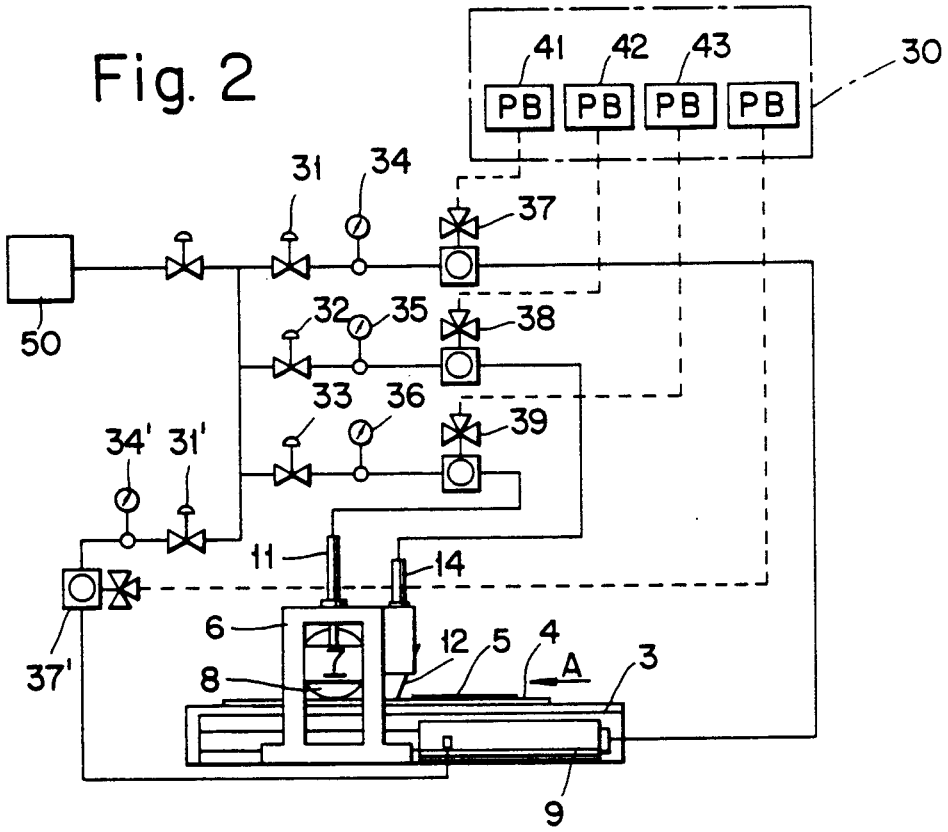
FIG. 2 shows the passage of compressed air in the apparatus in FIG. 1.

FIG. 1 is a perspective view of a printing testing apparatus according to one embodiment of the present invention. This apparatus is such a type that the impression cylinder is rotated at a fixed position while the intaglio mount is moved. FIG. 2 shows the compressed air passage in the apparatus shown in FIG. 1. In this apparatus, the intaglio mount is moved by the pneumatic cylinder and the printing pressure of the impression cylinder and the contact pressure of the doctor blade are also adjusted by pneumatic cylinders, respectively.

Referring now to FIGS. 1 through 6, the apparatus will be described in further detail. The apparatus includes a main body comprising a base 1, wall-like guides 2 standing on the base 1, opposing each other and each having a guide rail inside thereof, a movable intaglio mount 3 supported on the guides 2 and having an intaglio 4 (170 mm in width and 370 mm in length) on the surface thereof, a pair of heads 6 fixed on the base 1 outside the guides 2, a freely rotatable impression cylinder 8 provided in bearings 7 provided slidably in vertical direction inside the heads 6, a double-acting pneumatic cylinder 9 to move the intaglio mount 3 (of 300 mm in maximum stroke), double-acting pneumatic cylinders 11 for imparting a printing pressure between the impression cylinder 8 and intaglio 4, and having cylinder tubes fixed to tops of the heads 6 and piston rods 10 connected to the bearings 7, a doctor blade 12 for supplying an ink dropped onto the intaglio to a printing area 5 on the intaglio and scraping away the remainder of the ink, a support 13 to install the doctor blade to the heads 6, double-acting pneumatic cylinders 14 having their cylinder tubes connected to the heads 6 for imparting a pressure of contact between the doctor blade 12 and intaglio 4, a vertically sliding block 15 connected to piston rods of the pneumatic cylinders 14 to transmit the motion of the piston rods to the doctor blade support 13; and a control section comprising a compressor 50 (of 7 kg/m$^2$ in maximum discharge pressure) to supply a compressed air to each of the aforementioned pneumatic cylinders 9, 11 and 14 (see FIG. 2), valve control knobs 31, 32 and 33 to adjust the pressure of the compressed air from the compressor 50 to each of the pneumatic cylinders 9, 11 and 14, pressure gauges 34, 35 and 36, operation select pushbutton switches 41, 42 and 43, a control box 30 having a printing speed meter 44, etc. mounted thereon and incorporating control devices, a limit switch 45 for a stopper for position detection of the intaglio, a photo sensor 46 for detection of printing speed, a light shielding plate 47, solenoid valves 37, 38 and 39 for opening/closing compressed air passages, and etc.

Figure 3:
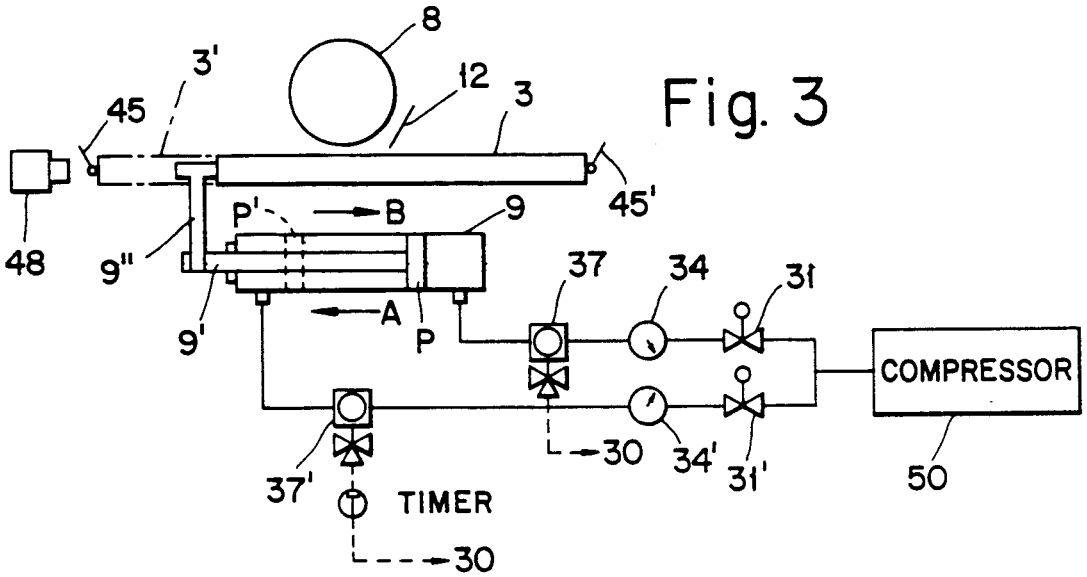
FIG. 3 is an explanatory drawing of the function of the pneumatic cylinders for movement of the intaglio.
Figure 4:
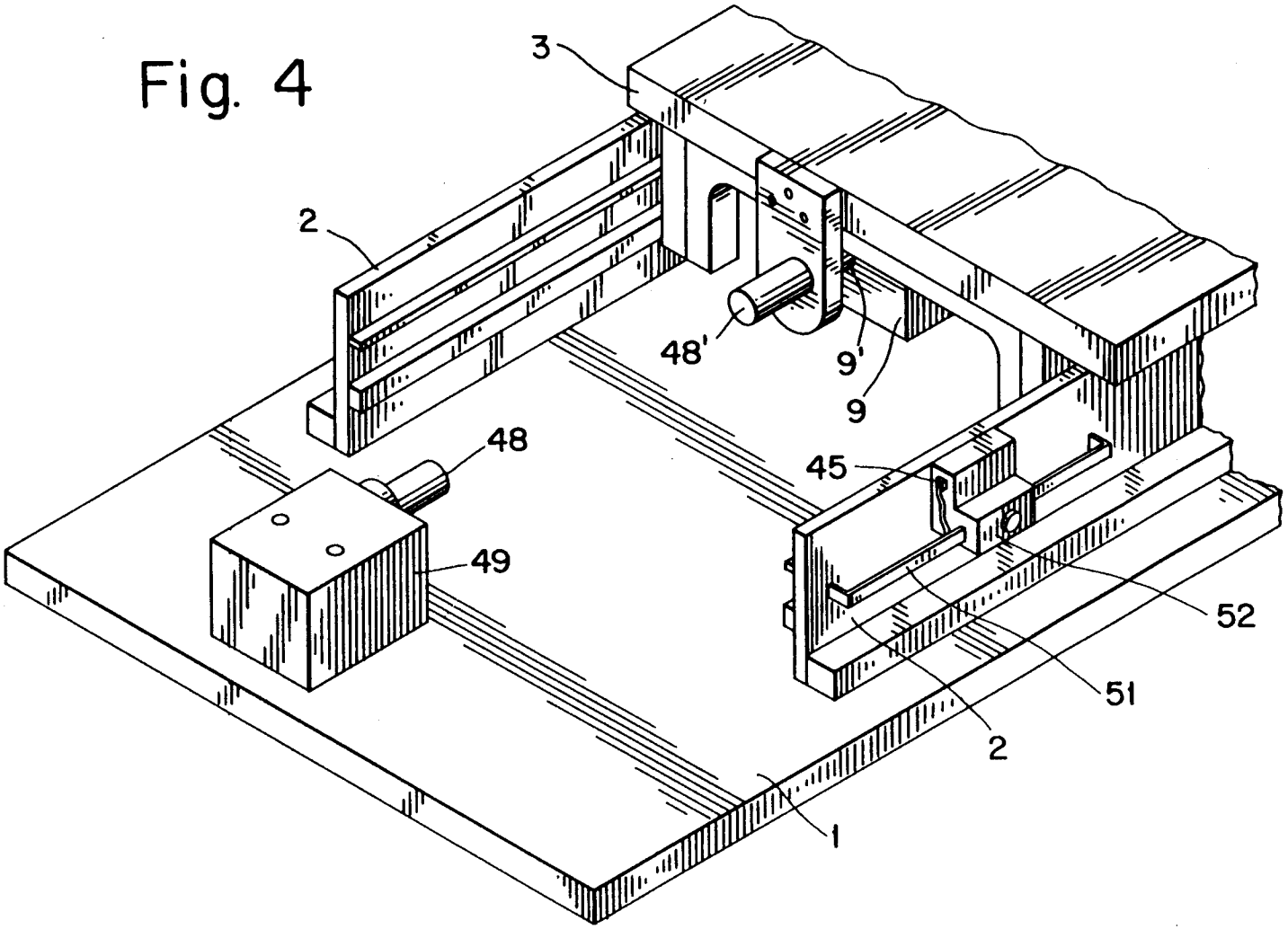
FIG. 4 is a perspective view showing the mechanism for moving and stopping the intaglio mount.

FIG. 3 shows the relation between the pneumatic cylinder 9 and compressed air controlling means. FIG. 4 is a perspective view of a mechanism to move and stop the intaglio mount 3, FIG. 5 is a side elevation of the head 6, and FIG. 6 is a partial perspective view of the fixture for the doctor blade 12.

Referring now to FIGS. 3 and 4, the movement, stopping and return to the initial position of the intaglio mount 3 will be explained below. Assuming that the position of the intaglio mount 3 indicated with a solid line is the initial position. A printing sheet is wounded on the impression cylinder 8, a printing ink is dropped onto the intaglio, the impression cylinder is lowered to apply a printing pressure, and the doctor blade 12 is lowered to apply a pressure to the intaglio. After completion of these operations for a printing, the print start switch on the control box is pressed to open the three-way solenoid valve 37, thereby supplying the compressed air to the pneumatic cylinder 9 and moving the piston P in the direction of arrow A at a high speed. When the piston P has moved to the position P', the intaglio mount 3 is also moved to the position 3'. At this time, the limit switch 45 for position detection of the intaglio mount is activated, and the three-way solenoid valve 37 is closed with a signal from the limit switch 45 through the electric circuit. Upon the supply of compressed air to the pneumatic cylinder 9 is stopped, the three-way solenoid valve 37 is opened by the timer T for a short time of less than 1 sec and supplies a compressed air for braking the piston P. Thereafter the intaglio mount 3 is moved somewhat, and then it is completely stopped by a stopper 48. At this time, the three-way solenoid valves 37 and 37' may be opened to the atmosphere or kept as closed.

FIG. 4 shows in detail the limit switch 45, stopper 48 and the guide 2. The limit switch 45 is adjustably installed to a guide bar 51 with a fixture, in such a manner that the switch is adjusted in an appropriate position according to a printing speed. The stopper 48 has in its body 49 a spring or pneumatic damper (not shown) which absorbs the impact when the stopper 48 collides with a stopper 48' on the intaglio mount.

Figure 5:
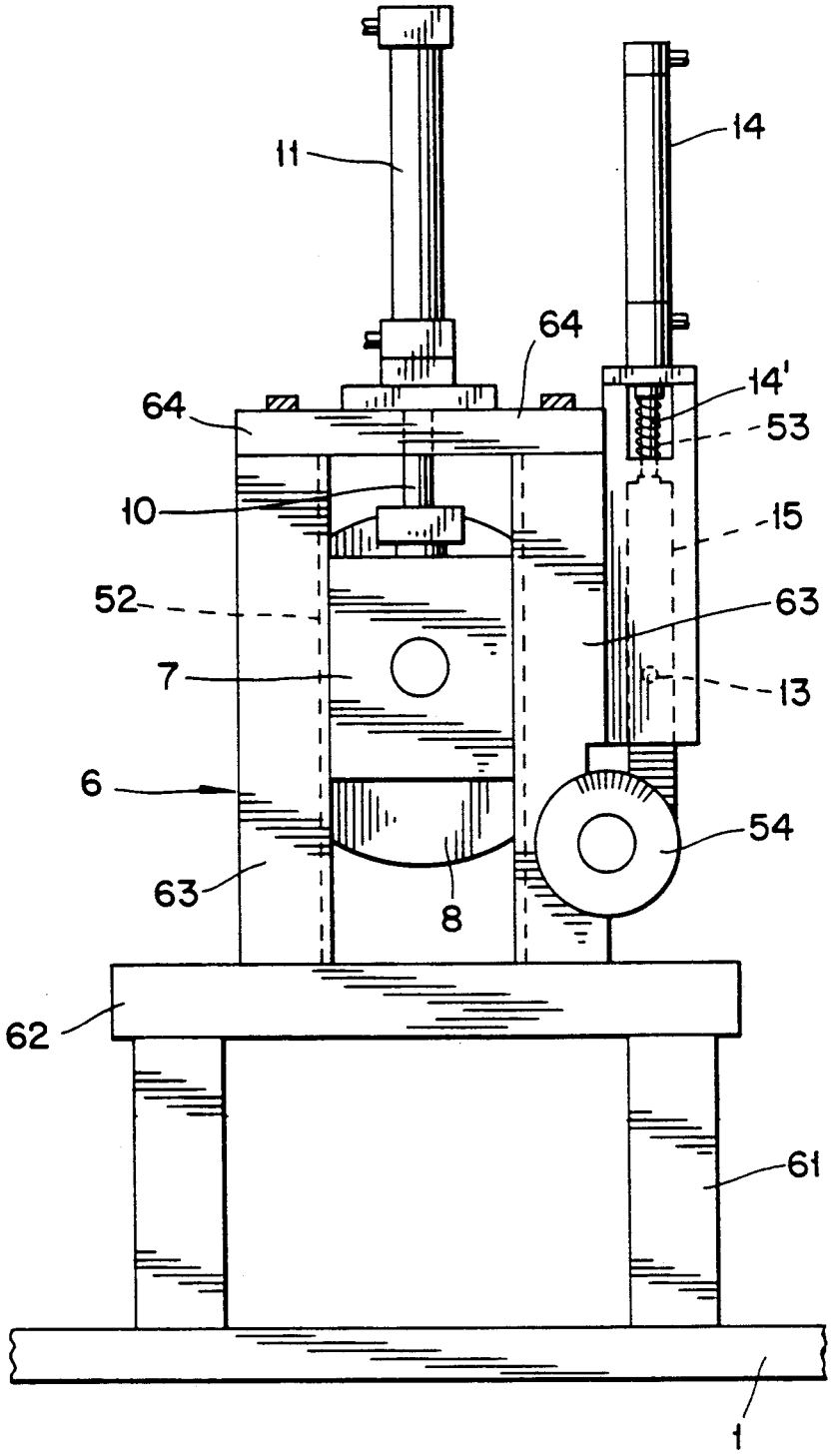
FIG. 5 is a side elevation of the head.
Figure 6:
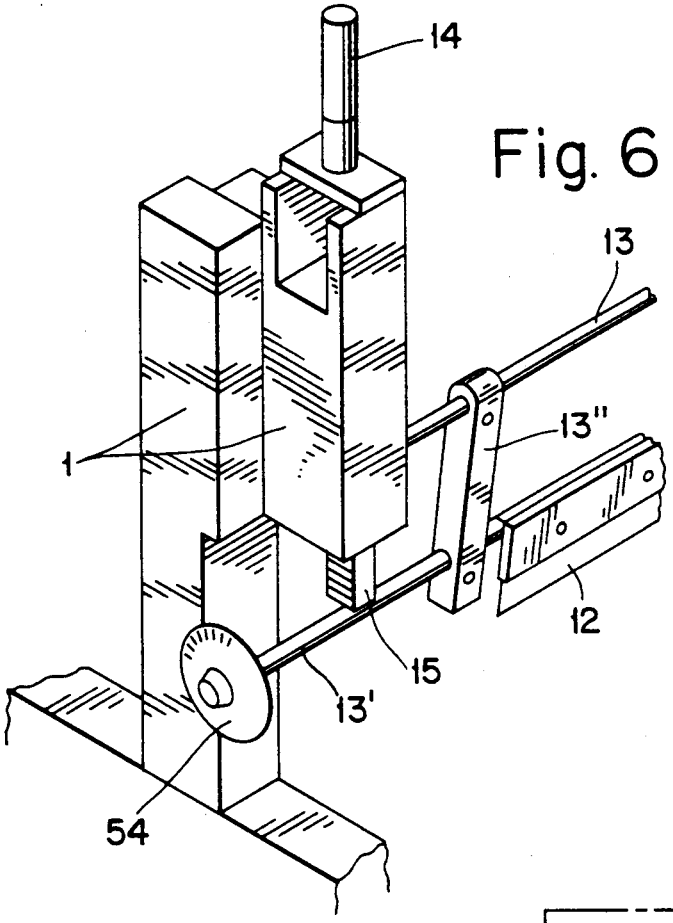
FIG. 6 shows the doctor blade and its fixture.

As shown in FIG. 5, the head 6 comprises frames 61, 62, 63, 64, and etc. fixed to the base 1, and a bearing block 7 is mounted between the frames 62 and 63. The bearing block 7 has on the lateral sides thereof ribs (not shown) fitted in recesses 52, respectively, in the frames 63. The bearing block 7 is thus vertically slidable along the recesses 52. The frame 64 has fixed thereon the tube of the pneumatic cylinder 11 and the piston rod 10 is connected to the aforementioned bearing 7.

The head 6 has installed thereon the doctor blade 12 which is supported by two rod-like supports 13 and 13' as shown in FIGS. 5 and 6. The support 13 is connected to the slide block 15 vertically slidable by the piston rod 14' of the pneumatic cylinder 14, while the support 13' is connected to the support 13 by means of a connecting bar 13''. The doctor blade 12 has the angle adjusted by means of a knob 54 provided at the end of the support 13'.

Note that the pneumatic cylinder 14 is of a double-acting type. When a pressure of contact with the intaglio is generated by lowering the doctor blade 12 and when the doctor blade 12 is separated from the intaglio, a compressed air is supplied to the pneumatic cylinder 14 to drive the piston in the opposite directions. It is desired that, when lowering the doctor blade 12, the compressed air is supplied at two steps by a needle valve to the pneumatic cylinder 14, thereby avoiding any abrupt contact between the doctor blade 12 and intaglio. The spring 53 serves to absorb the impact of the doctor blade 12 at its stroke end.

Figure 7:
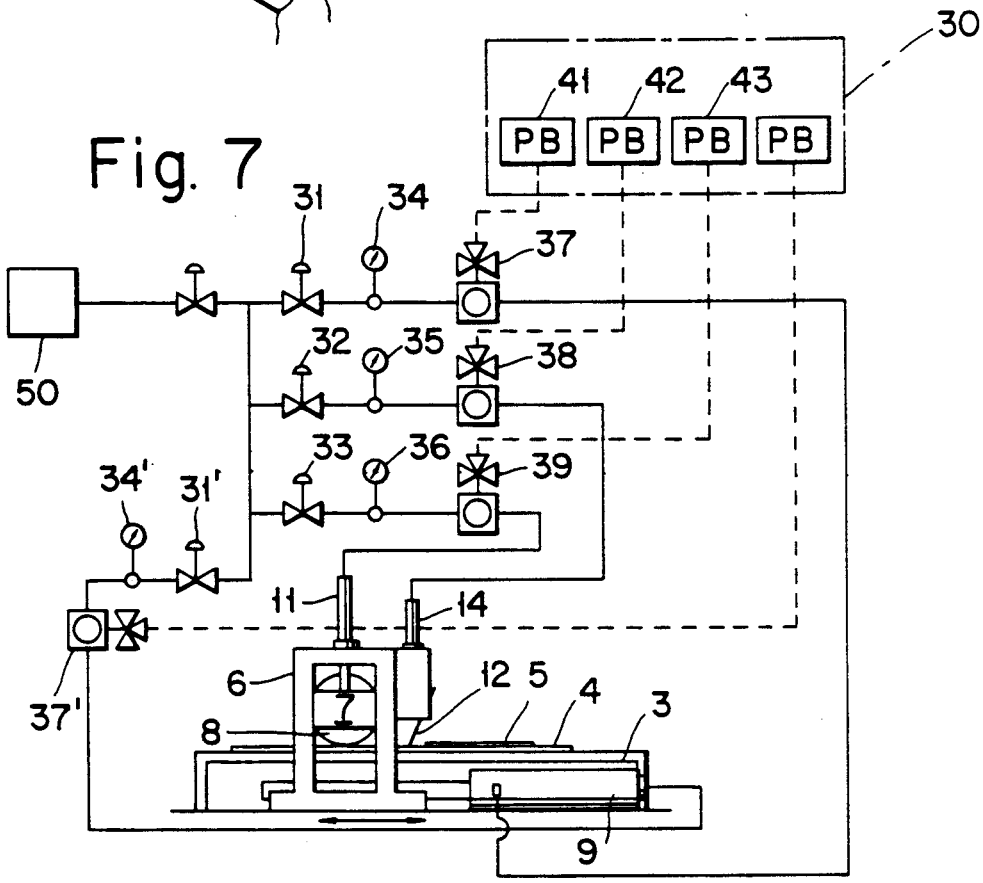
FIG. 7 is a schematic view of a second embodiment of the present invention.

In the foregoing, the embodiment of a printing testing apparatus according to the present invention of a type in which the intaglio is moved has been described. As shown in FIG. 7, the printing testing apparatus of a type in which the head is moved is basically the same as the intaglio-moving type except the pneumatic cylinder 9 is attached to the head 6.

Referring now to FIG. 2, the procedure of executing the method according to the present invention will be described below:

(1) The compressor 50 is put into operation, and the throttle valve 31 is adjusted while watching the pressure gauge 34 to supply the pneumatic cylinder 9 with a compressed air matching to a desired printing speed. Similarly, for a necessary printing pressure and contact pressure of the doctor blade, the throttle valves 32 and 33 are adjusted while watching the pressure gauges 35 and 36, respectively.

(2) The intaglio 4 is installed and fixed to the intaglio mount 3.

(3) The printing sheet is attached on the impression cylinder 8.

(4) The ink is dropped parallelly with the doctor blade and between the doctor blade 12 and the printing area 5 on the intaglio 4.

(5) The impression cylinder down push-button 41 is pressed, then the doctor blade down push-button 42 is pressed and the print start button 43 is pressed to activate the pneumatic cylinders 11, 14 and 8 one after another, thereby starting a print. After completion of the print, the impression cylinder and doctor blade are automatically raised.

(6) The printing sheet on which the print has been made is removed from the impression cylinder 8.

(7) The reverse button 43' (FIG. 1) is pressed to return the intaglio mount 3 to its initial position, and the intaglio is cleaned by using a solvent and waste. Also the doctor blade 12 is opened upward, cleaned and returned to its initial position.

It should be noted that the printing speed can be adjusted by means of the throttle valve 31 and pressure gauge 34 based on the index line prepared beforehand. A real printing speed can be measured by the photo sensor 46 and light shield plate 47 shown in FIG. 1. With this apparatus, a calculator in the control box can calculate a time for which the light received by the photo sensor 46 is intercepted by the light shielding plate 47, and the calculated value can be digitally indicated like "80 m/min" in a meter 44 on the control box.

By repeating the steps (3) through (7), it is possible to print using a same intaglio and different kinds of ink as necessary. Each time other parameters such as printing sheet, intaglio, printing speed, printing pressure, pressure of contact with the doctor blade are used, the steps (1) through (7) are effected sequentially.

According to the present invention, the following effects can be expected.

(1) By moving the intaglio mount or impression cylinder by means of the pneumatic cylinders, it is possible to execute accurately and simply the steps of stop, high-speed movement, slow down and stop in this order. The body of the drive for the movement can be made extremely rigid, thereby ensuring a stable reproducibility for a long time.

(2) By imparting the printing pressure of the impression cylinder by means of the pneumatic or hydraulic cylinders provided at opposite ends of the impression cylinder, it is possible to impart always a same printing pressure at any position and under any set conditions regardlessly of any warp, inclination, etc. of the intaglio. Namely, the reproducibility is quite excellent.

(3) Also concerning the contact pressure of the doctor blade, an excellent reproducibility as in (2) above can be assured.

(4) Even after replacement of the intaglio, impression cylinder, doctor blade and printing sheet, preceding or new printing conditions can be set very simply, rapidly and with a high accuracy.

(5) Owing to the total of the effects in the above, it is possible to obtain a high accuracy printing with an extremely excellent reproducibility of printing, ensure a very high accuracy of color matching and make a much contribution to the rationalization of a printing process.

We claim:

1. A method for performing a printing test, comprising the steps of:

dropping ink onto a flat intaglio;

supplying said ink to a printing area on the intaglio with a doctor blade;

transferring said ink from said printing area onto a printing sheet by rolling an impression cylinder having said printing sheet wound on a circumference thereof, over said printing area under a predetermined printing pressure in relation to said intaglio wherein said rolling of said impression cylinder includes moving said impression cylinder from an initial position to perform a printing operation, stopping said impression cylinder and returning said impression cylinder to an initial position and is performed by means of a pneumatic cylinder;

controlling said rolling of said impression cylinder by adjusting a pressure of air supplied to said pneumatic cylinder;

controlling said predetermined printing pressure of said impression cylinder in relation to said intaglio by adjusting a pressure cylinder that is connected with said impression cylinder.

2. A method for performing a printing test as set forth in claim 1, wherein said rolling of said impression cylinder is performed by a double acting pneumatic cylinder having first and second cylinder chambers separated by a piston and wherein said controlling of the rolling of said impression cylinder is performed by supplying compressed air to one of said first and second chambers by a solenoid valve.

3. A method for performing a printing test as set forth in claim 2, wherein said controlling of the rolling of said impression cylinder includes supplying said compressed air to said first chamber to move said impression cylinder in one direction to perform said printing operation and, after a completion of the printing operation, supplying said compressed air to said second chamber to brake said impression cylinder from movement in said one direction.

4. A method for performing a printing test as set forth in claim 2, wherein a speed of said impression cylinder during said return of the impression cylinder to said initial position is slower than a speed of said impression cylinder during said movement to perform a printing operation.

5. A printing test apparatus, including a base, an intaglio mount movable along a guide on the base, a head secured to said base, an impression cylinder rotatably mounted on said head and having a circumference adapted for receiving a printing sheet, and a doctor blade provided on said head comprising:

a pneumatic cylinder for moving said intaglio having a cylinder tube fixed to said base and a piston rod connected to said intaglio mount;

an impression cylinder unit including a bearing block and a first pressure cylinder for imparting a printing pressure to said impression cylinder, said bearing block vertically slidably supported on said head, said first pressure cylinder having a piston rod connected to one of said bearing block and said head and a cylinder tube fixed to the other of said bearing block and said head;

a doctor blade support unit including a doctor blade support and a second pressure cylinder for adjusting a contact pressure of said doctor blade, said doctor blade support being vertically slidably supported on said head, said second pressure cylinder having a piston rod connected to one of said head and said doctor blade support and a cylinder tube fixed to the other of said head and said doctor blade;

a pressure medium supply unit to supply a pressure medium to each of said pneumatic cylinder, a first pressure cylinder and second pressure cylinder; and means for selectively adjusting a pressure of said pressure medium in each of said cylinders.

6. A printing testing apparatus as set forth in claim 5, wherein said first and second pressure cylinders are pneumatic cylinders.

7. A printing testing apparatus, including a base, an intaglio mount provided on said base, a head movable along a guide provided on said base, an impression cylinder rotatably mounted on said head and having a circumference adapted for receiving a printing sheet, and a doctor blade provided on said head comprising:

a pneumatic cylinder for moving said head having a cylinder tube fixed to said base and a piston rod connected to said head;

an impression cylinder unit including a bearing block and a first pressure cylinder for imparting a printing pressure to said impression cylinder, said bearing block being vertically slidably supported on said head, said first pressure cylinder having a piston rod connected to one of said bearing block and said head and a cylinder tube fixed to the other of said bearing block and said head;

a doctor blade support unit including a doctor blade support and a second pressure cylinder for adjusting a pressure of contact of said doctor blade, said doctor blade support vertically slidably supported on said head, said second pressure cylinder having a piston rod connected to one of said head and said doctor blade support and a cylinder tube fixed to the other of said head and said doctor blade;

a pressure medium supply unit to supply a pressure medium to each of said pneumatic cylinder, first pressure cylinder and second pressure cylinder; and means for selectively adjusting a pressure of said pressure medium in each of said cylinders.

8. A printing testing apparatus as set forth in claim 7, wherein said first and second pressure cylinders are pneumatic cylinders.

9. A printing testing apparatus as set forth in claim 5, wherein said first and second pressure cylinders are hydraulic cylinders.

10. A printing test apparatus as set forth in claim 7, wherein said first and second pressure cylinders are hydraulic cylinders.

11. A method for performing a printing test, comprising the steps of:

dropping ink onto a flat intaglio;

supplying said ink to a printing area on the intaglio by means of a doctor blade;

transferring said ink from said printing area onto a printing sheet by reciprocating said intaglio underneath a rotatable impression cylinder at a predetermined printing pressure, said impression cylinder having said printing sheet mounted on a circumference thereof, wherein said reciprocating of said intaglio includes moving said intaglio from an initial position to perform a printing operation, stopping said intaglio and returning said intaglio to an initial position and is performed by means of a pneumatic cylinder;

controlling said reciprocating of said intaglio by adjusting a pressure of air supplied to said pneumatic cylinder;

controlling said predetermined printing pressure of said impression cylinder in relation to said intaglio by adjusting a pressure cylinder that is connected with said impression cylinder.

12. A method for performing a printing test as set forth in claim 11, wherein said reciprocating of said intaglio is performed by a double acting pneumatic cylinder having first and second cylinder chambers separated by a piston and wherein said controlling of the reciprocating of said intaglio is performed by supplying compressed air to one of said first and second chambers by a solenoid valve.

13. A method for performing a printing test as set forth in claim 12, wherein said controlling of the reciprocating of said intaglio includes supplying said compressed air to said first chamber to move said intaglio in one direction to perform said printing operation and, after a completion of the printing operation, supplying said compressed air to said second chamber to brake said intaglio from movement in said one direction.

14. A method for performing a printing test as set forth in claim 12, wherein a speed of said intaglio during said return of the intaglio to the initial position is slower than a peed of said intaglio during said movement to perform a printing operation.

15. A method for performing a printing test, comprising the steps of:

dropping ink onto a flat intaglio;

supplying said ink to a printing area on the intaglio by means of a doctor blade;

transferring said ink from said printing area onto a printing sheet by reciprocating one of a rotatable impression cylinder and said intaglio relative to the other of said rotatable impression cylinder and said intaglio at a predetermined printing pressure between said impression cylinder and said intaglio, said impression cylinder having said printing sheet mounted on a circumference thereof, wherein said reciprocating of one of said impression cylinder and said intaglio includes moving said one of said impression cylinder and said intaglio to perform a print operation, stopping said one of said impression cylinder and said intaglio and returning said one of said impression cylinder and said intaglio to an initial position and is performed by means of a pneumatic cylinder;

controlling said reciprocating of said one of said impression cylinder and said intaglio by adjusting a pressure of fluid supplied to said pneumatic cylinder;

controlling said predetermined printing pressure between said impression cylinder and said intaglio by adjusting a pressure cylinder that is interconnected with said impression cylinder.

16. A printing testing apparatus comprising a base, an intaglio mount, a head supported by said base, a rotatable impression cylinder rotatably mounted on said head and having a circumference adapted for receiving a printing sheet and a doctor blade provided on said head one of said intaglio and said impression cylinder being movable along a guide on the base, said printing testing apparatus further comprising:

a pneumatic cylinder for moving said one of said intaglio and said impression cylinder having a cylinder tube fixed to said base and a piston rod connected to said intaglio mount;

an impression cylinder unit including a bearing block and a first pressure cylinder for imparting a printing pressure to said impression cylinder, said bearing block vertically slidably supported on said head, said first pressure cylinder having a piston rod connected to one of said bearing block and said head and a cylinder tube fixed to the other of said bearing block and said head;

a doctor blade support unit including a doctor blade support and a second pressure cylinder for adjusting a contact pressure of said doctor blade, said doctor blade support vertically slidably supported on said head, said second pressure cylinder having a piston rod connected to one of said head and said doctor blade support and a cylinder tube fixed to the other of said head and said doctor blade;

a pressure medium supply unit to supply a pressure medium to each of said pneumatic cylinder, first pressure cylinder and second pressure cylinder; and means for adjusting a pressure of said pressure medium.

* * * * *